US011784393B2

(12) United States Patent
Huang et al.

(10) Patent No.: US 11,784,393 B2
(45) Date of Patent: Oct. 10, 2023

(54) ANTENNA MODULE

(71) Applicant: PEGATRON CORPORATION, Taipei (TW)

(72) Inventors: Chin-Ting Huang, Taipei (TW); Hsi-Kai Hung, Taipei (TW); Sony Chayadi, Taipei (TW); Chun-Kai Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 71 days.

(21) Appl. No.: 17/519,381

(22) Filed: Nov. 4, 2021

(65) Prior Publication Data

US 2022/0149528 A1 May 12, 2022

(30) Foreign Application Priority Data

Nov. 6, 2020 (TW) ..... 109138931

(51) Int. Cl.

| | |
|---|---|
| ***H01Q 1/24*** | (2006.01) |
| ***H01Q 21/28*** | (2006.01) |
| ***H01Q 13/10*** | (2006.01) |
| ***H01Q 9/28*** | (2006.01) |
| ***H01Q 9/30*** | (2006.01) |
| ***H01Q 13/18*** | (2006.01) |

(52) U.S. Cl.

CPC ..... *H01Q 1/24* (2013.01); *H01Q 9/28* (2013.01); *H01Q 9/30* (2013.01); *H01Q 13/10* (2013.01); *H01Q 13/18* (2013.01); *H01Q 21/28* (2013.01)

(58) Field of Classification Search

CPC .. H01Q 1/2258; H01Q 1/2266; H01Q 1/2291; H01Q 1/24; H01Q 1/241; H01Q 1/242; H01Q 1/243; H01Q 1/36; H01Q 1/44; H01Q 1/48; H01Q 5/20; H01Q 5/25; H01Q 5/30; H01Q 5/307; H01Q 5/342; H01Q 5/35; H01Q 5/357; H01Q 9/0421; H01Q 9/16; H01Q 9/26; H01Q 9/265; H01Q 9/28; H01Q 9/30; H01Q 9/38; H01Q 9/40; H01Q 9/42; H01Q 13/10; H01Q 13/103; H01Q 13/12; H01Q 13/14; H01Q 13/18; H01Q 21/28

See application file for complete search history.

(56) References Cited

U.S. PATENT DOCUMENTS

| | | | | |
|---|---|---|---|---|
| 5,754,143 | A | 5/1998 | Warnagiris et al. | |
| 2014/0266920 | A1* | 9/2014 | Tran | H01Q 1/243 343/702 |
| 2020/0015340 | A1 | 1/2020 | Louh et al. | |

FOREIGN PATENT DOCUMENTS

| | | |
|---|---|---|
| TW | 201820702 | 6/2018 |

* cited by examiner

*Primary Examiner* — Robert Karacsony
(74) *Attorney, Agent, or Firm* — J.C. PATENTS

(57) ABSTRACT

An antenna module includes a hollow cylindrical conductor structure. The hollow cylindrical conductor structure includes a cylinder wall, at least one first slot, and a first feed point. The at least one first slot and the first feed point are located on the cylinder wall. The cylinder wall includes a first end edge and a second end edge opposite to each other. The at least one first slot extends from an internal position of the cylinder wall to the first end edge, and forms a first closed path together with the first end edge. The first feed point is located beside the at least one first slot. The antenna module is adapted to excite a first frequency band through the first closed path.

9 Claims, 7 Drawing Sheets

ANTENNA MODULE

CROSS-REFERENCE TO RELATED APPLICATION

This application claims the priority benefit of Taiwanese application no. 109138931, filed on Nov. 6, 2020. The entirety of the above-mentioned patent application is hereby incorporated by reference herein and made a part of this specification.

BACKGROUND

Technical Field

The disclosure relates to an antenna module.

Description of Related Art

The conventional electronic devices where a metal shell is adopted as the radiation conductor of the antenna mostly requires to dispose complicated slots to form a planar inverted-F antenna (PIFA) or a dipole antenna. However, not only excessive or complicated slots may result in fragility of the metal shell structure, but the slots may also require to be filled and beautified with plastic, increasing costs of the manufacturing process.

SUMMARY

The disclosure provides an antenna module with a simple structure.

An antenna module of the disclosure includes a hollow cylindrical conductor structure. The hollow cylindrical conductor structure includes a cylinder wall, at least one first slot, and a first feed point. The first slot and the first feed point are located on the cylinder wall. The cylinder wall includes a first end edge and a second end edge opposite to each other. The at least one first slot extends from an internal position of the cylinder wall to the first end edge, and forms a first closed path together with the first end edge. The first feed point is located beside the at least one first slot. The antenna module is adapted to excite a first frequency band through the first closed path.

In an embodiment of the disclosure, each of the at least one first slot has a plurality of widths.

In an embodiment of the disclosure, a functional element is adapted to be disposed in the first slot. A shape of the first slot corresponds to a shape of the functional element.

In an embodiment of the disclosure, the at least one first slot includes a plurality of first slots being separate from each other and extending from the cylinder wall to the first end edge. The first slots form the first closed path together with the first end edge.

In an embodiment of the disclosure, the hollow cylindrical conductor structure further includes a first plate disposed on the first end edge of the cylinder wall. The first plate is an insulating member.

In an embodiment of the disclosure, the hollow cylindrical conductor structure further includes a second plate disposed on the second end edge of the cylinder wall.

In an embodiment of the disclosure, the antenna module is further adapted to excite a second frequency band and a third frequency band through the first closed path. A length of the first closed path is 1 time a wavelength of the first frequency band, 1.5 times a wavelength of the second frequency band, and 2 times a wavelength of the third frequency band.

In an embodiment of the disclosure, the hollow cylindrical conductor structure includes a second slot and a second feed point located on the cylinder wall. The second slot extends from the cylinder wall to the second end edge, and forms a second closed path together with the second end edge. The second feed point is located in a portion of the cylinder wall beside the second slot.

In an embodiment of the disclosure, the antenna module further includes a circuit board and a metal elastic member. The circuit board includes a grounding surface. The circuit board is disposed in the hollow cylindrical conductor structure. The metal elastic member is disposed between the cylinder wall and the grounding surface to connect the cylinder wall and the grounding surface.

In an embodiment of the disclosure, the hollow cylindrical conductor structure has a cylindrical shape, an elliptical-cylindrical shape, or a polygonal-cylindrical shape.

Based on the foregoing, the antenna module of the disclosure includes the hollow cylindrical conductor structure. The first slot of the hollow cylindrical conductor structure extends from an internal position of the cylinder wall to the first end edge, and forms the first closed path together with the first end edge. The first feed point is located beside the first slot. With the above design, the antenna module is adapted to excite the first frequency band through the first closed path.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
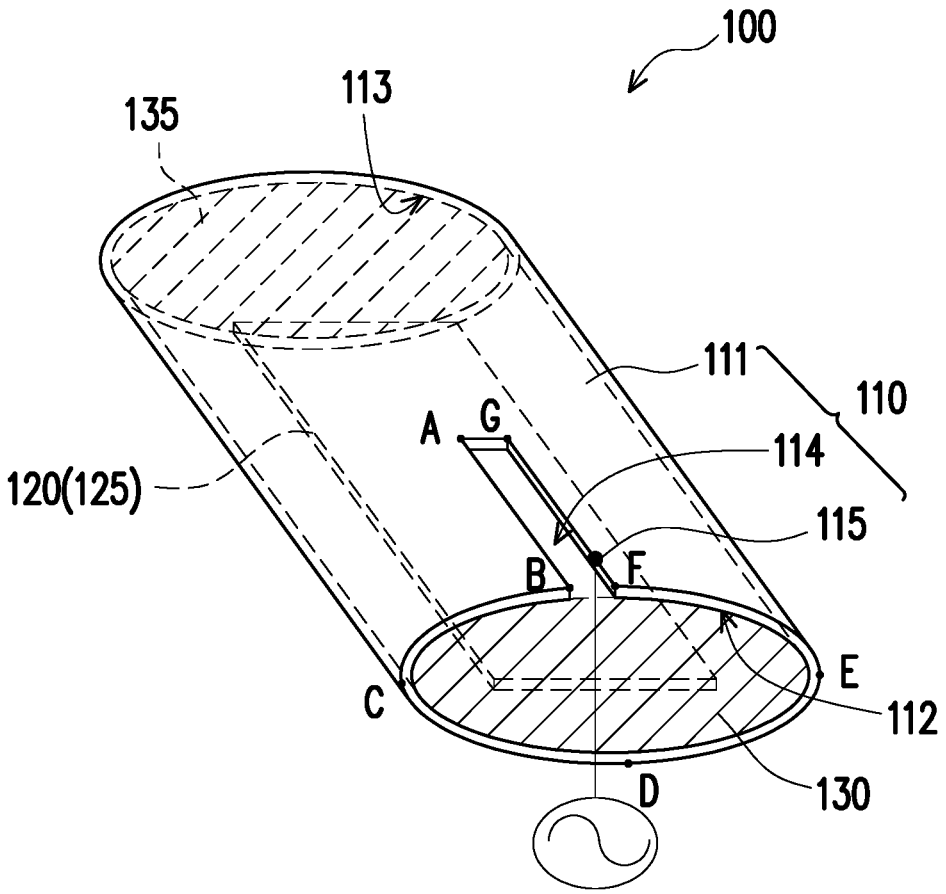
FIG. 1 is a schematic diagram of an antenna module according to an embodiment of the disclosure.

FIG. 1 is a schematic diagram of an antenna module according to an embodiment of the disclosure. With reference to FIG. 1, an antenna module 100 of this embodiment is, for example, applied to a cylindrical electronic device, such as an electronic cigarette, an MP3 player, a metal remote control, a metal watch, or other electronic devices, and the application of the antenna module 100 is not limited thereto.

In this embodiment, the antenna module 100 includes a hollow cylindrical conductor structure 110. The hollow cylindrical conductor structure 110 has an elliptical-cylindrical shape, for example. In addition, in other embodiments, the hollow cylindrical conductor structure 110 may also have a cylindrical shape or a polygonal-cylindrical shape (e.g., a rectangular cylinder). When the hollow cylindrical conductor structure 110 is applied to different products, the shape of the hollow cylindrical conductor structure 110 may be adjusted accordingly, and is not limited to the drawings.

The hollow cylindrical conductor structure 110 includes a cylinder wall 111, at least one first slot 114, and a first feed point 115. The at least one first slot 114 and the first feed point 115 are located on the cylinder wall 111. In this embodiment, the first slot 114 is one first slot, but in other embodiments, the first slot 114 may include a plurality of first slots. The cylinder wall 111 includes a first end edge 112 (e.g., the lower elliptical end edge) and a second end edge 113 (e.g., the upper elliptical end edge) opposite to each other. The first slot 114 extends from an internal position of the cylinder wall 111 to the first end edge 112, and forms a first closed path together with the first end edge 112, sequentially from a position A to a position G and the back to the position A.

In this embodiment, the first slot 114 is located on the cylinder wall 111 of the hollow cylindrical conductor structure 110, and the first end edge 112 is located at the bottom of the hollow cylindrical conductor structure 110. Therefore, the first slot 114 and the first end edge 112 are located on different planes, such that the first closed path (sequentially from the position A to the position G and then back to the position A) is a three-dimensional closed path.

The first feed point 115 is located beside the first slot 114. In addition, the antenna module 100 may optionally include a grounding surface 120. The grounding surface 120 is located on a circuit board 125. The grounding surface 120 is disposed in the hollow cylindrical conductor structure 110. In this embodiment, the first slot 114 is located above the grounding surface 120. Nonetheless, the position and the shape of the first slot 114 are not limited thereto.

Figure 2:
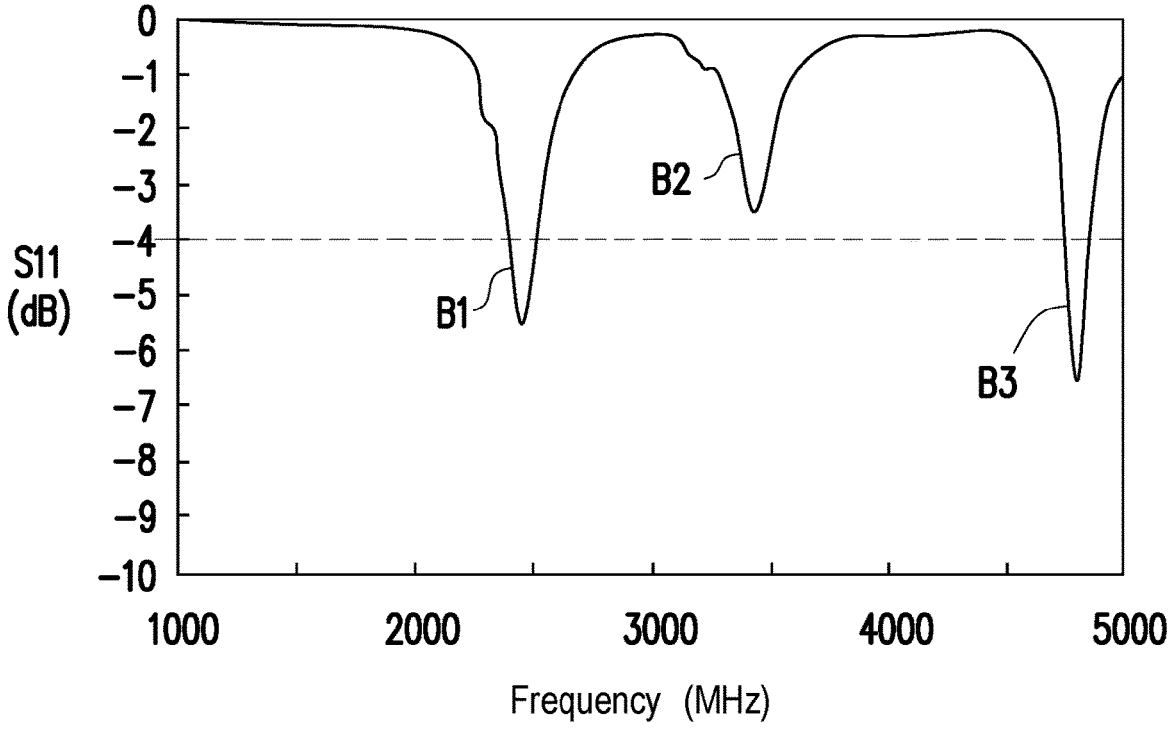
FIG. 2 is a schematic diagram of frequency-S11 of the antenna module of FIG. 1.

In this embodiment, a length of the first closed path (sequentially from the position A to the position G and then back to the position A) is 1 time a wavelength of a first frequency band B1, 1.5 times a wavelength of a second frequency band B2, and 2 times a wavelength of a third frequency band B3. Therefore, the antenna module 100 can excite the first frequency band B1, the second frequency band B2, and the third frequency band B3 through the first closed path, as shown in FIG. 2.

In this embodiment, the center frequency of the first frequency band B1 is 2450 MHz, and the first frequency band B1 covers the Bluetooth frequency band and Wi-Fi 2.4G frequency band. The center frequency of the second frequency band B2 is 3675 MHz, and the center frequency of the third frequency band B3 is 4900 MHz. Nonetheless, the first frequency band B1, the second frequency band B2, and the third frequency band B3 are not limited thereto.

In an embodiment, the three frequency bands may be applied to 5G. The first frequency band may be n41 (2496 to 2690 MHz), the second frequency band may be n78 (3300 to 3800 MHz), and the third frequency band may be n79 (4400 to 5000 MHz).

Since the angle of the excitation current flowing through the first closed path (sequentially from the position A to the position G and then back to the position A) is 360 degrees, and the first closed path is a three-dimensional closed path, such a design effectively reduces the antenna blind cone in transmission and reception, and provides improved communication quality. In actual tests, the transmission/connection distance of Bluetooth signals reaches at least 70 meters, exhibiting improved performance.

In addition, in this embodiment, the hollow cylindrical conductor structure 110 further includes a first plate 130 and a second plate 135. The first plate 130 is disposed on the first end edge 112 of the cylinder wall 111 and may close the opening of the first end edge 112 to maintain the completeness in appearance. The second plate 135 is disposed on the second end edge 113 of the cylinder wall 111 and may close the opening of the second end edge 113 to maintain the completeness in appearance. The first plate 130 is an insulating part to prevent influences on the antenna performance. The second plate 135 may be a conductor or an insulator.

Moreover, in this embodiment, the grounding surface 120 is, for example, disposed on one surface of the circuit board 125, while a microprocessor chip, RF circuit, or/and baseband circuit may be disposed on the other surface of the circuit board 125. Furthermore, a Bluetooth chip or Wi-Fi chip may be integrated into the microprocessor chip, but is not limited thereto.

Figure 3:
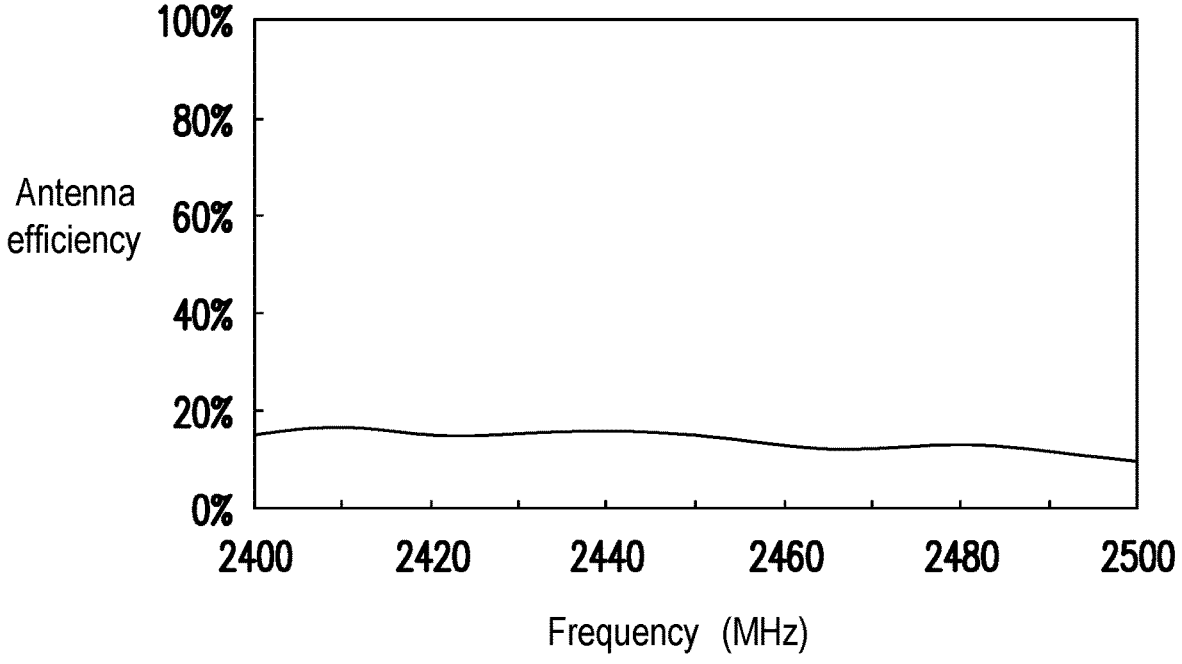
FIG. 3 is a schematic diagram of frequency-antenna efficiency of the antenna module of FIG. 1.

FIG. 2 is a schematic diagram of frequency-S11 of the antenna module of FIG. 1. With reference to FIG. 2, in this embodiment, S11 of the antenna module 100 in each of the first frequency band B1 (with a center frequency of 2450 MHz), the second frequency band B2 (with a center frequency of 3675 MHz), and the third frequency band B3 (with a center frequency of 4900 MHz) is less than −3 dB. In particular, S11 in each of the first frequency band B1 (with a center frequency of 2450 MHz) and the third frequency band B3 (with a center frequency of 4900 MHz) is less than −5 dB, exhibiting improved performance. FIG. 3 is a schematic diagram of frequency-antenna efficiency of the antenna module of FIG. 1. With reference to FIG. 3, in this embodiment, the antenna module 100 in the first frequency band B1 (with a frequency from 2400 MHz to 2500 MHz, covering the Bluetooth frequency band and Wi-Fi 2.4G frequency band) has an antenna efficiency higher than 10%, exhibiting improved performance.

Figure 4:
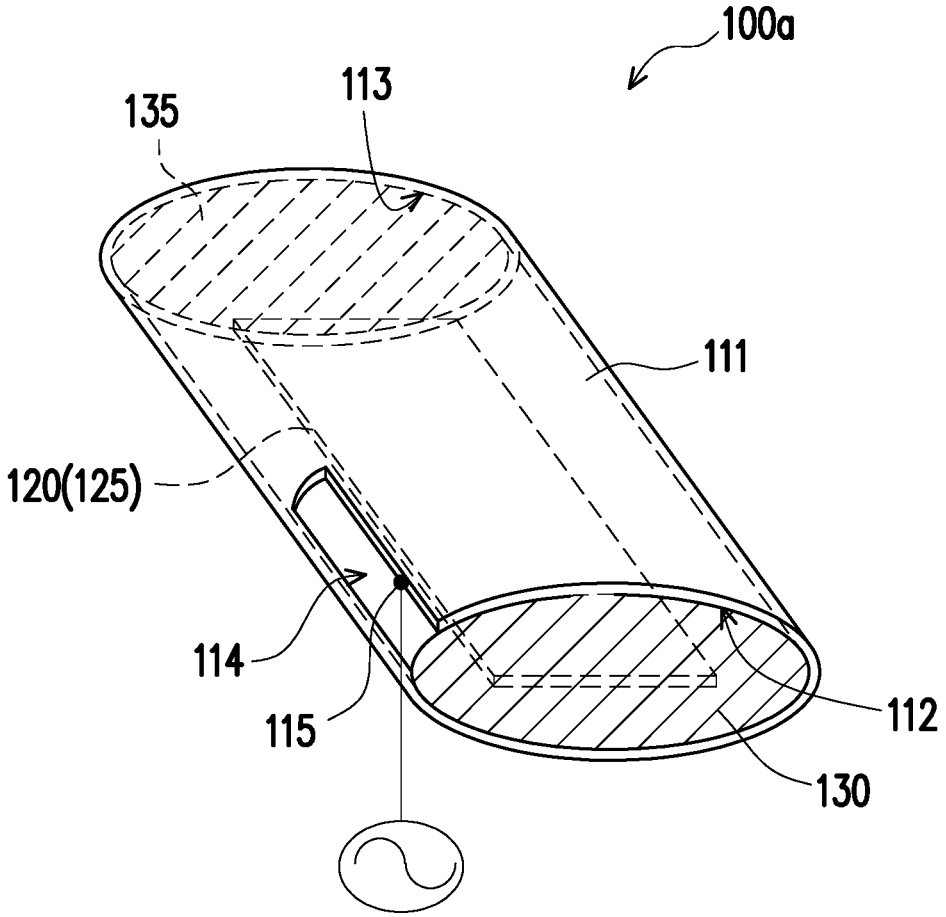
FIG. 4 to FIG. 8 are schematic diagrams of a plurality of antenna modules according to other embodiments of the disclosure.

FIG. 4 to FIG. 8 are schematic diagrams of a plurality of antenna modules according to other embodiments of the disclosure. With reference to FIG. 4 first, the main difference between an antenna module 100*a* in FIG. 4 and the antenna module 100 in FIG. 1 is that, in this embodiment, the first slot 114 is not located above the grounding surface 120, but located beside a side edge of the grounding surface 120. In this embodiment, since the length of the first closed path formed by the first slot 114 and the first end edge 112 is equal to or close to the length of the first closed path in FIG. 1, as shown in FIG. 2, the antenna module 100*a* may also excite the first frequency band B1, the second frequency band B2, and the third frequency band B3, exhibiting improved performance.

Figure 5:
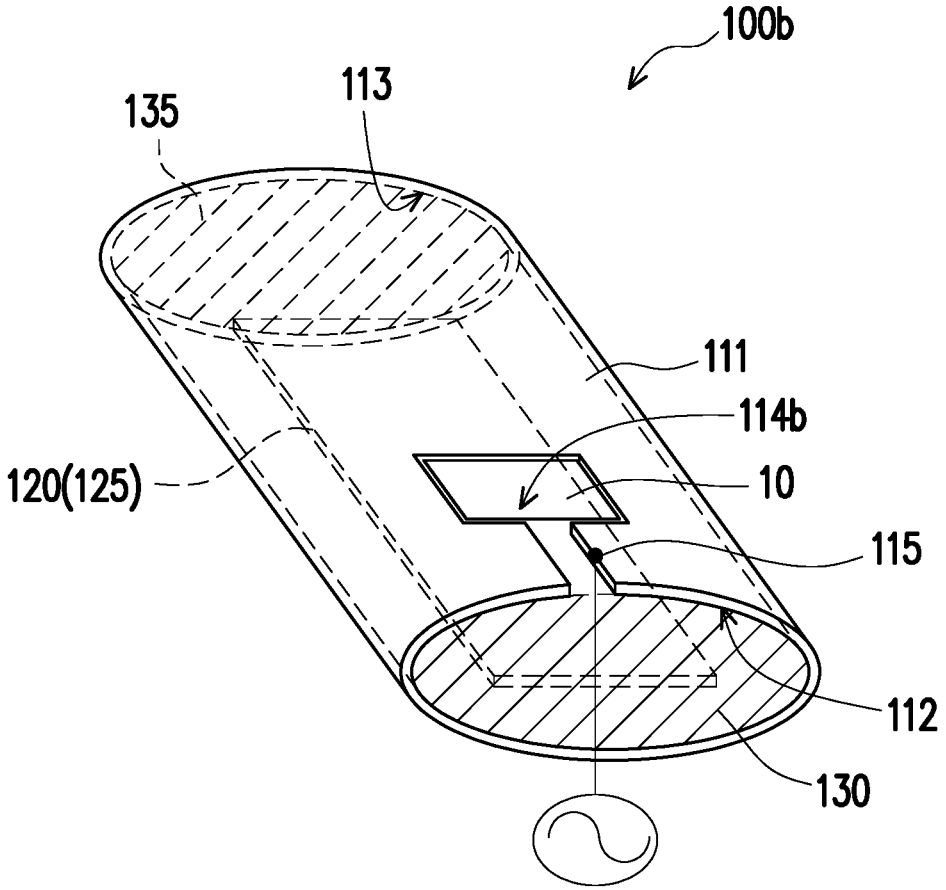

With reference to FIG. 5, the main difference between an antenna module 100*b* in FIG. 5 and the antenna module 100 in FIG. 1 is that, in this embodiment, a first slot 114*b* has a plurality of widths. For example, the width of the first slot 114*b* at a position close to the first end edge 112 is smaller than the width of the first slot 114*b* at a position away from the first end edge 112. In this embodiment, a functional element 10 may be disposed in the first slot 114*b*, and the shape of the first slot 114*b* corresponds to the shape of the functional element 10.

The functional element 10 is, for example, an LED light, a button, a suction nozzle, a liquid crystal module display, or a charging dock. Accordingly, it is neither necessary to fill the first slot 114*b* with plastic members, nor additionally spray coating thereon to beautify the appearance, which saves costs. Notably, in other embodiments, even if the first slot has a single width, the functional element 10 may still be disposed in the first slot, and is not limited to the drawings.

Figure 6:
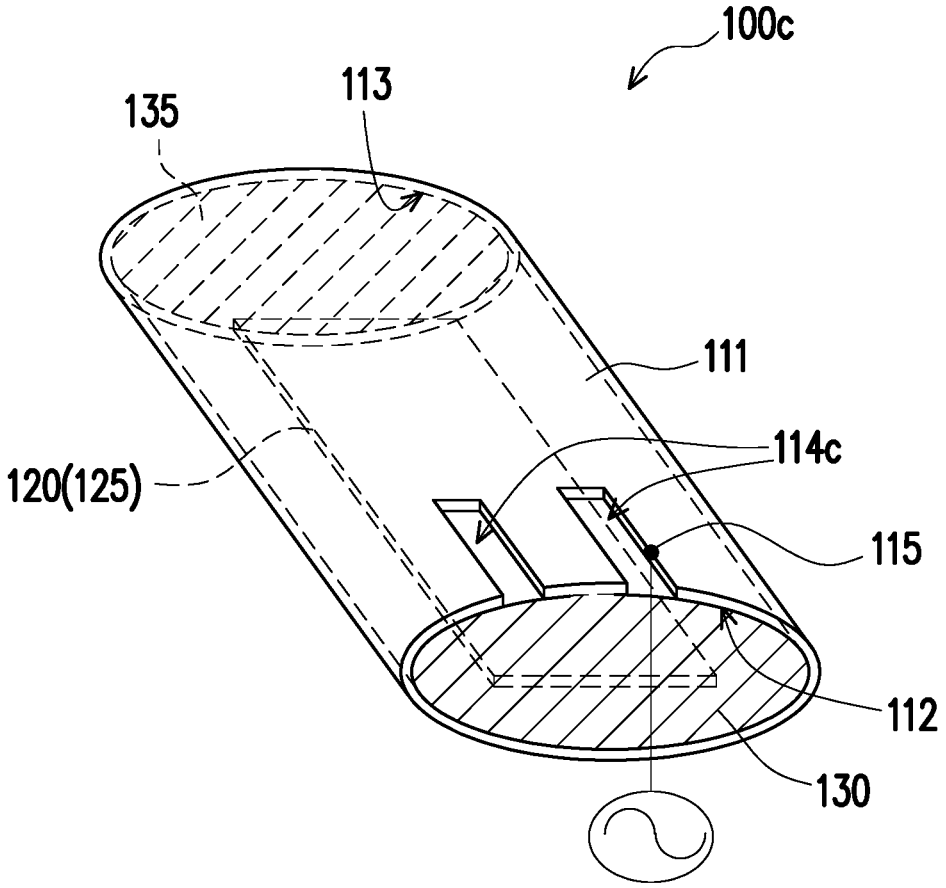

With reference to FIG. 6, the main difference between an antenna module 100*c* in FIG. 6 and the antenna module 100 in FIG. 1 is that, in this embodiment, at least one first slot 114*c* includes two separate first slots 114*c*, each extending from the cylinder wall 111 to the first end edge 112. The first slots 114*c* and the first end edge 112 together form a first closed path. In this embodiment, the length of the first closed path formed by the first slots 114*c* and the first end edge 112 is equal to or close to the length of the first closed path formed by the first slot 114 and the first end edge 112 of FIG. 1. Therefore, as shown in FIG. 2, the antenna module 100*c* may also excite the first frequency band B1, the second frequency band B2, and the third frequency band B3 through the first closed path.

Figure 7:
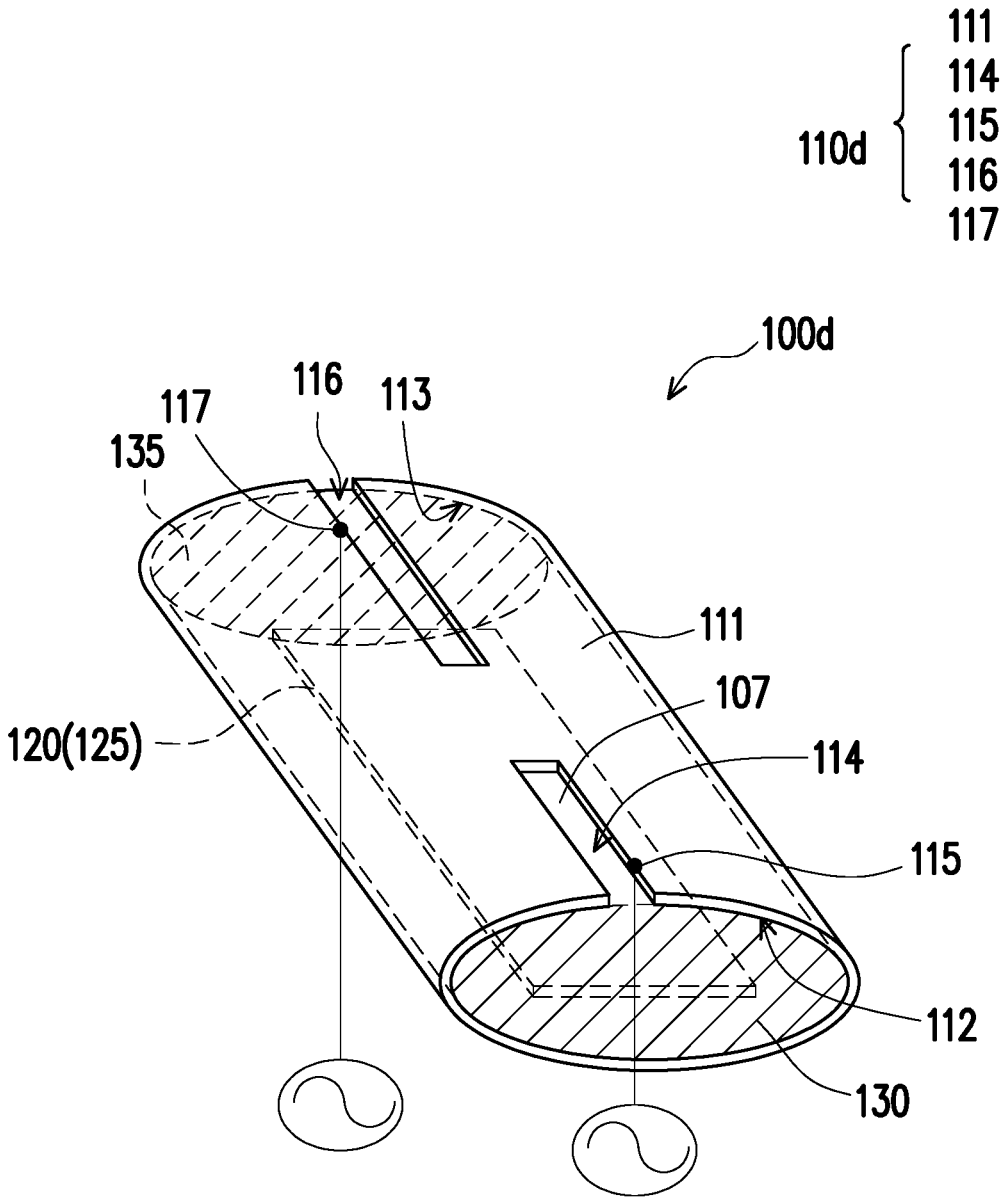

With reference to FIG. 7, the main difference between an antenna module 100*d* in FIG. 7 and the antenna module 100 in FIG. 1 is that, in this embodiment, a hollow cylindrical conductor structure 110*d* further includes a second slot 116 and a second feed point 117 located on the cylinder wall 111. The second slot 116 extends from the cylinder wall 111 to the second end edge 113, and forms a second closed path together with the second end edge 113. The second feed point 117 is located in a portion of the cylinder wall 111 beside the second slot 116.

That is, in this embodiment, the antenna module 100*d* has a dual-antenna structure, in which the first slot 114 and the first end edge 112 together form one antenna, and the second slot 116 and the second end edge 113 together form the other antenna. In addition, in this embodiment, the second plate 135 is an insulator to prevent influences on the antenna performance.

Figure 8:
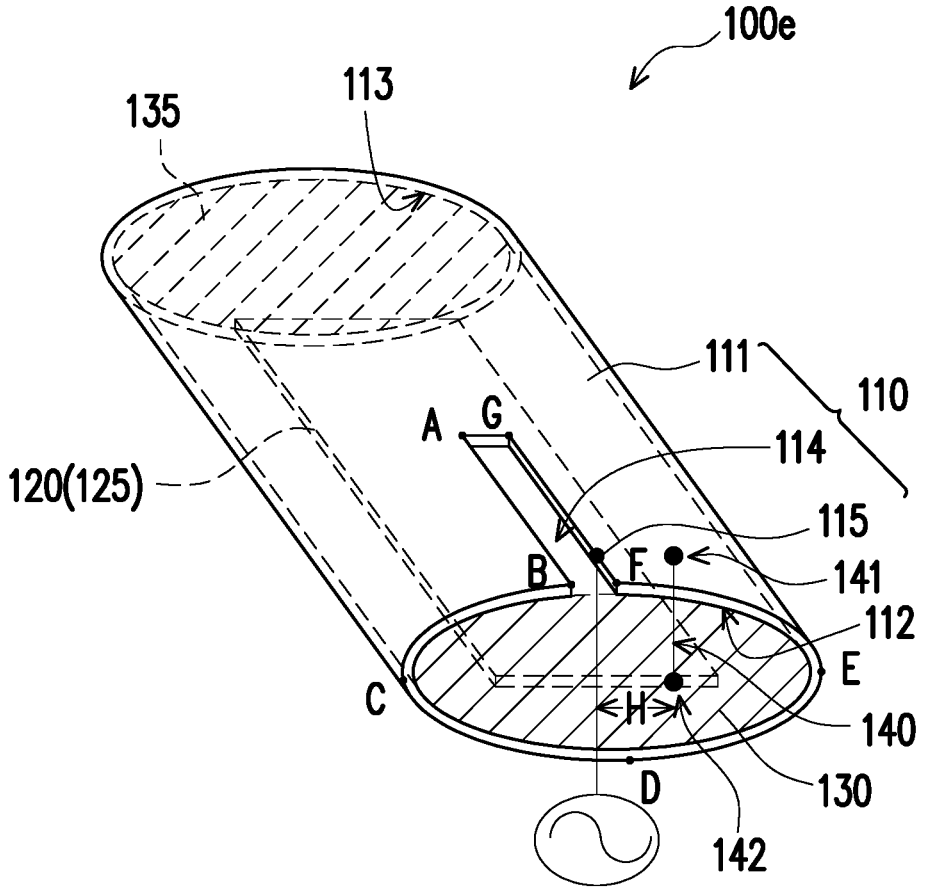

With reference to FIG. 8, the main difference between an antenna module 100*e* in FIG. 8 and the antenna module 100 in FIG. 1 is that, in this embodiment, the antenna module 100*e* further includes a metal elastic member 140 disposed between the cylinder wall 111 and the grounding surface 120 to connect the cylinder wall 111 and the grounding surface 120. The metal elastic member 140 may control impedance matching such that the feed impedance of the first feed point 115 reaches 50Ω. The metal elastic member 140 has a first end 141 connected to the cylinder wall 111 and a second end 142 connected to the grounding surface. A distance H between the first feed point 115 and the metal elastic member 140 may be adjusted such that the feed impedance of the first feed point 115 is 50Ω.

In summary of the foregoing, the antenna module of the disclosure includes the hollow cylindrical conductor structure. The first slot of the hollow cylindrical conductor structure extends from an internal position of the cylinder wall to the first end edge, and forms the first closed path together with the first end edge. The first feed point is located beside the first slot. With the above design, the antenna module is adapted to excite the first frequency band, the second frequency band, and the third frequency band through the first closed path, and serve as a multi-frequency antenna.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An antenna module, comprising:

a hollow cylindrical conductor structure, comprising a cylinder wall, at least one first slot, and a first feed point, wherein the at least one first slot and the first feed point are located on the cylinder wall, the cylinder wall comprises a first end edge and a second end edge opposite to each other, the at least one first slot extends from an internal position of the cylinder wall to the first end edge, and forms a first closed path together with the first end edge, and the first feed point is located beside the at least one first slot, wherein the antenna module is adapted to excite a first frequency band through the first closed path;

a circuit board, comprising a grounding surface, wherein the circuit board is disposed in the hollow cylindrical conductor structure; and a metal elastic member, wherein the metal elastic member is disposed between the cylinder wall and the grounding surface to connect the cylinder wall and the grounding surface.

2. The antenna module according to claim 1, wherein each of the at least one first slot has a plurality of widths.

3. The antenna module according to claim 1, wherein a functional element is adapted to be disposed in the first slot, and a shape of the first slot corresponds to a shape of the functional element.

4. The antenna module according to claim 1, wherein the at least one first slot comprises a plurality of first slots being separate from each other and extending from the cylinder wall to the first end edge, and the first slots form the first closed path together with the first end edge.

5. The antenna module according to claim 1, wherein the hollow cylindrical conductor structure further comprises a first plate disposed on the first end edge of the cylinder wall, and the first plate is an insulating member.

6. The antenna module according to claim 1, wherein the hollow cylindrical conductor structure further comprises a second plate disposed on the second end edge of the cylinder wall.

7. The antenna module according to claim 1, being further adapted to excite a second frequency band and a third frequency band through the first closed path, and a length of the first closed path is 1 time a wavelength of the first frequency band, 1.5 times a wavelength of the second frequency band, and 2 times a wavelength of the third frequency band.

8. The antenna module according to claim 1, wherein the hollow cylindrical conductor structure comprises a second slot and a second feed point located on the cylinder wall, the second slot extends from the cylinder wall to the second end edge, and forms a second closed path together with the second end edge, and the second feed point is located in a portion of the cylinder wall beside the second slot.

9. The antenna module according to claim 1, wherein the hollow cylindrical conductor structure has a cylindrical shape, an elliptical-cylindrical shape, or a polygonal-cylindrical shape.

* * * * *